US009918176B2

(12) United States Patent
Feng

(10) Patent No.: US 9,918,176 B2
(45) Date of Patent: Mar. 13, 2018

(54) AUDIO SYSTEM TUNING

(71) Applicant: Lenovo (Singapore) Pte. Ltd., Singapore (SG)

(72) Inventor: Xin Feng, Morrisville, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 70 days.

(21) Appl. No.: 14/276,478

(22) Filed: May 13, 2014

(65) Prior Publication Data

US 2015/0334503 A1 Nov. 19, 2015

(51) Int. Cl.

| | |
|---|---|
| ***H04R 5/02*** | (2006.01) |
| ***H04S 7/00*** | (2006.01) |
| ***H04R 5/00*** | (2006.01) |
| ***H04S 3/00*** | (2006.01) |

(52) U.S. Cl.

CPC ..... *H04S 7/302* (2013.01); *H04R 5/00* (2013.01); *H04S 3/008* (2013.01); *H04S 7/301* (2013.01)

(58) Field of Classification Search

CPC ..... H04S 1/005; H04S 2420/01
USPC ..... 381/310
See application file for complete search history.

(56) References Cited

U.S. PATENT DOCUMENTS

2008/0276793 A1* 11/2008 Yamashita ..... G10H 1/0091 84/611
2011/0228983 A1* 9/2011 Matsuda ..... G06F 3/167 382/103
2012/0050582 A1* 3/2012 Seshadri ..... H04N 13/0018 348/241
2012/0093320 A1* 4/2012 Flaks ..... A63F 13/10 381/17
2012/0306850 A1* 12/2012 Balan ..... G06T 19/006 345/419
2013/0083011 A1* 4/2013 Geisner ..... G09G 5/00 345/419
2013/0208898 A1* 8/2013 Vincent ..... H04S 7/303 381/17
2013/0208900 A1* 8/2013 Vincent ..... H04S 7/303 381/17
2014/0152758 A1* 6/2014 Tong ..... H04M 1/72555 348/14.02

* cited by examiner

*Primary Examiner* — Simon King
(74) *Attorney, Agent, or Firm* — Ference & Associates LLC

(57) ABSTRACT

An embodiment provides a system, including: a sensor; a processor operatively coupled to the sensor; and a memory storing instructions executable by the processor to: capture, using the sensor, depth data related to at least one position within an area; determine characteristics associated with the at least one position based on the depth data; and configure audio output to one or more speakers of an audio system based on the acoustic characteristics. Other aspects are described and claimed.

20 Claims, 4 Drawing Sheets

AUDIO SYSTEM TUNING

BACKGROUND

Currently, audio system tuning places requirements on the end-user. In essence, the tuning process requires attaching a special microphone to the audio system (e.g., the AV receiver), and playing a pre-made recording through each speaker. The audio produced by each speaker and detected by the special microphone is analyzed to decide how to tune each speaker, e.g., modify or configure the audio output of each speaker in the system. This cumbersome process of tuning must be done at each user-specified location in a minimum noise environment.

BRIEF SUMMARY

In summary, one aspect provides a system, comprising: a sensor; a processor operatively coupled to the sensor; and a memory storing instructions executable by the processor to: capture, using the sensor, depth data related to at least one position within an area; determine characteristics associated with the at least one position based on the depth data; and configure audio output to one or more speakers of an audio system based on the acoustic characteristics.

Another aspect provides a method, comprising: capturing, using a sensor, depth data related to at least one position within an area; determining, using a processor, characteristics associated with the at least one position based on the depth data; and configuring, using a processor, audio output to one or more speakers of an audio system based on the acoustic characteristics.

A further aspect provides a computer program product, comprising: a computer readable storage device having program executable code embodied therewith, the code being executable by a processor and comprising: code that captures, using a sensor, depth data related to at least one position within an area; code that determines, using a processor, characteristics associated with the at least one position based on the depth data; and code that configures, using a processor, audio output to one or more speakers of an audio system based on the acoustic characteristics.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
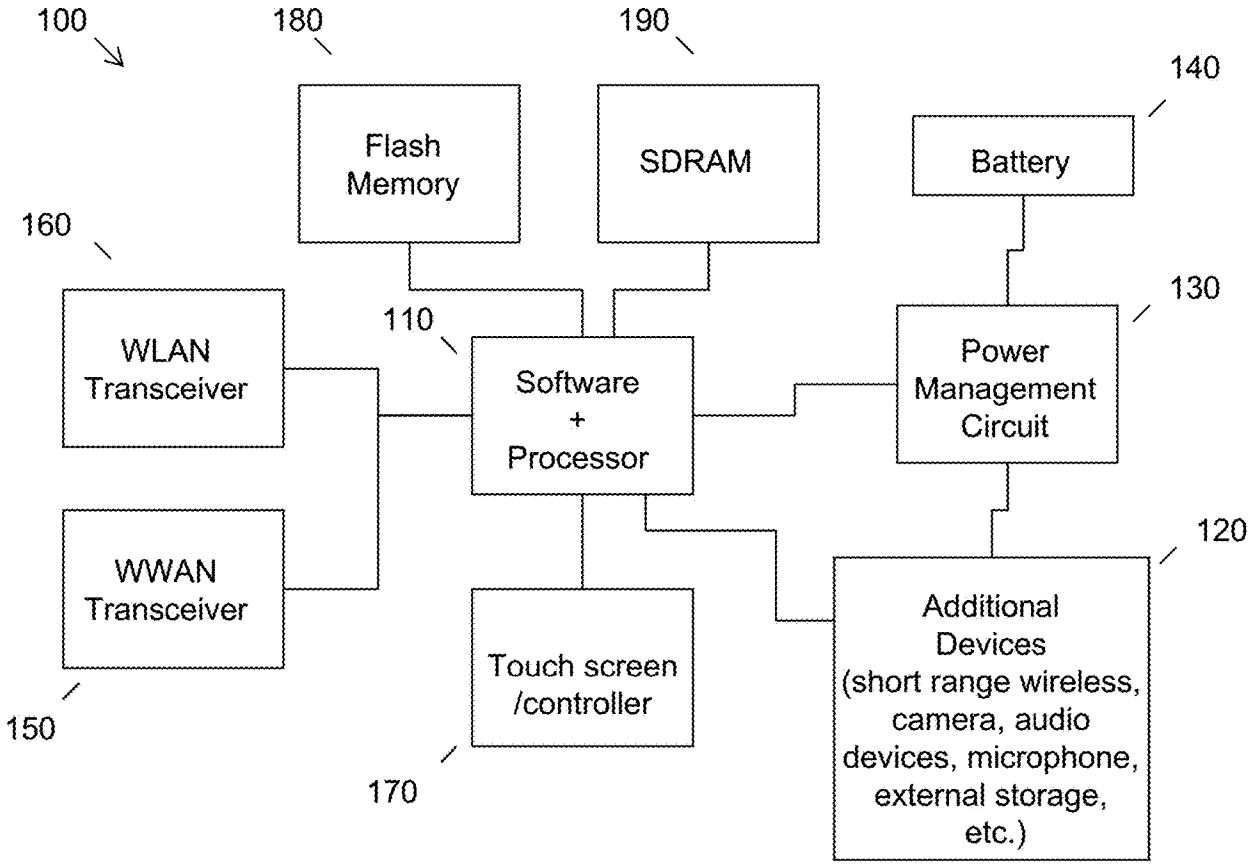
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Considering conventional audio system tuning, a number of problems can be summarized, as follows. Currently the tuning process is time consuming. For example, a 5.1 speaker system (a.k.a., audio system) tuning process may take 20 minutes. The conventional tuning process should be conducted in a minimum noise environment, which is a challenge to achieve. The audio systems are tuned for a balance of all specific user locations and it is assumed, because of the cumbersome conventional tuning process, that those locations are static. This results in some users not optimizing the audio system for a specific user location, in other words, skipping the tuning process or part thereof.

Accordingly, an embodiment utilizes a sensor, e.g., a camera or other device(s), having an image/depth field sensing capability that may be used to implement audio system tuning, e.g., even repeated or real-time tuning given its convenience. By way of example, an embodiment uses the image/depth field sensing, which may be integrated in the audio system itself (e.g., a component such as the AV receiver) or may be provided by the other device(s) operatively connected to the audio system (e.g., a TV having a sensor capability, a gaming device such as a MICROSOFT KINECT gaming device, etc). KINECT is a registered trademark of Microsoft Corporation in the United States and/or other countries.

The sensor may provide data, e.g., depth field data or depth data, that is used to detect object locations of the area, e.g., the location of furniture, user listening positions, etc., in order to develop a sound profile for the area, e.g., a living room. The sensor data may thus be used to determine a user listening position, e.g., a position on a couch or chair, with respect to distance from AV receiver. There could be one or more users listening to the system at one given time.

The audio system thus will be able to characterize the room layout/sound profile based on the depth field detection. As an example, furniture dimension/distance in the room may be determined; and thus, the sound profile of the room determined or characterized. The audio system will be able to detect the speakers' locations, e.g., distance to the AV receiver as part of this characterization process.

Based on the information gathered by the sensor and represented in the depth field data, the audio system (e.g., AV receiver) will be able to optimize the speaker output configuration (e.g., speaker settings) for the current room configuration, i.e., using the room's sound profile.

The illustrated example embodiments will be best understood by reference to the figures. The following description is intended only by way of example, and simply illustrates certain example embodiments.

While various other circuits, circuitry or components may be utilized in information handling devices, with regard to smart phone and/or tablet circuitry 100, an example illustrated in FIG. 1 includes a system design found for example in tablet or other mobile computing platforms. Software and processor(s) are combined in a single unit 110. Processors comprise internal arithmetic units, registers, cache memory, busses, I/O ports, etc., as is well known in the art. Internal busses and the like depend on different vendors, but essentially all the peripheral devices (120) may attach to a single unit 110. The circuitry 100 combines the processor, memory control, and I/O controller hub all into a single unit 110. Also, systems 100 of this type do not typically use SATA or PCI or LPC. Common interfaces, for example, include SDIO and $I^2C$.

There are power management unit(s) 130, e.g., a battery management unit, BMU, which manages power as supplied, for example, via a rechargeable battery 140, which may be recharged by a connection to a power source (not shown). In at least one design, a single unit, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally devices 120 are commonly included, e.g., an image sensor such as a camera. System 100 often includes a touch screen 170 for data input and display/rendering. System 100 also typically includes various memory devices, for example flash memory 180 and SDRAM 190.

Figure 2:
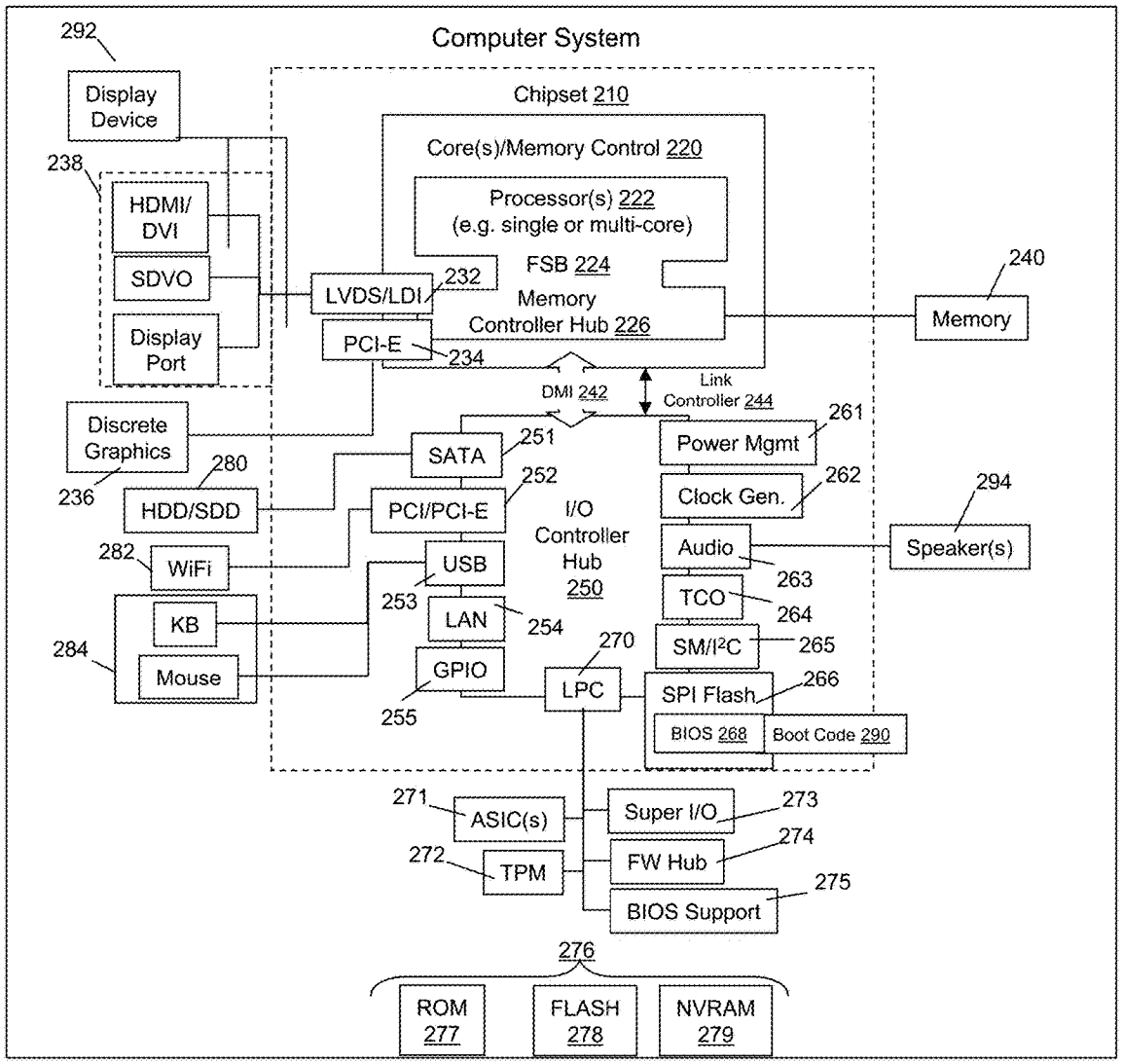
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a LVDS interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 2, may be used in an audio system, e.g., including using an audio interface 263 to control an AV receiver that provides output to speakers 294. As another example, an audio system may include a sensor, e.g., a camera 120 included with a device or circuitry as outlined in the example of FIG. 1.

Figure 3:
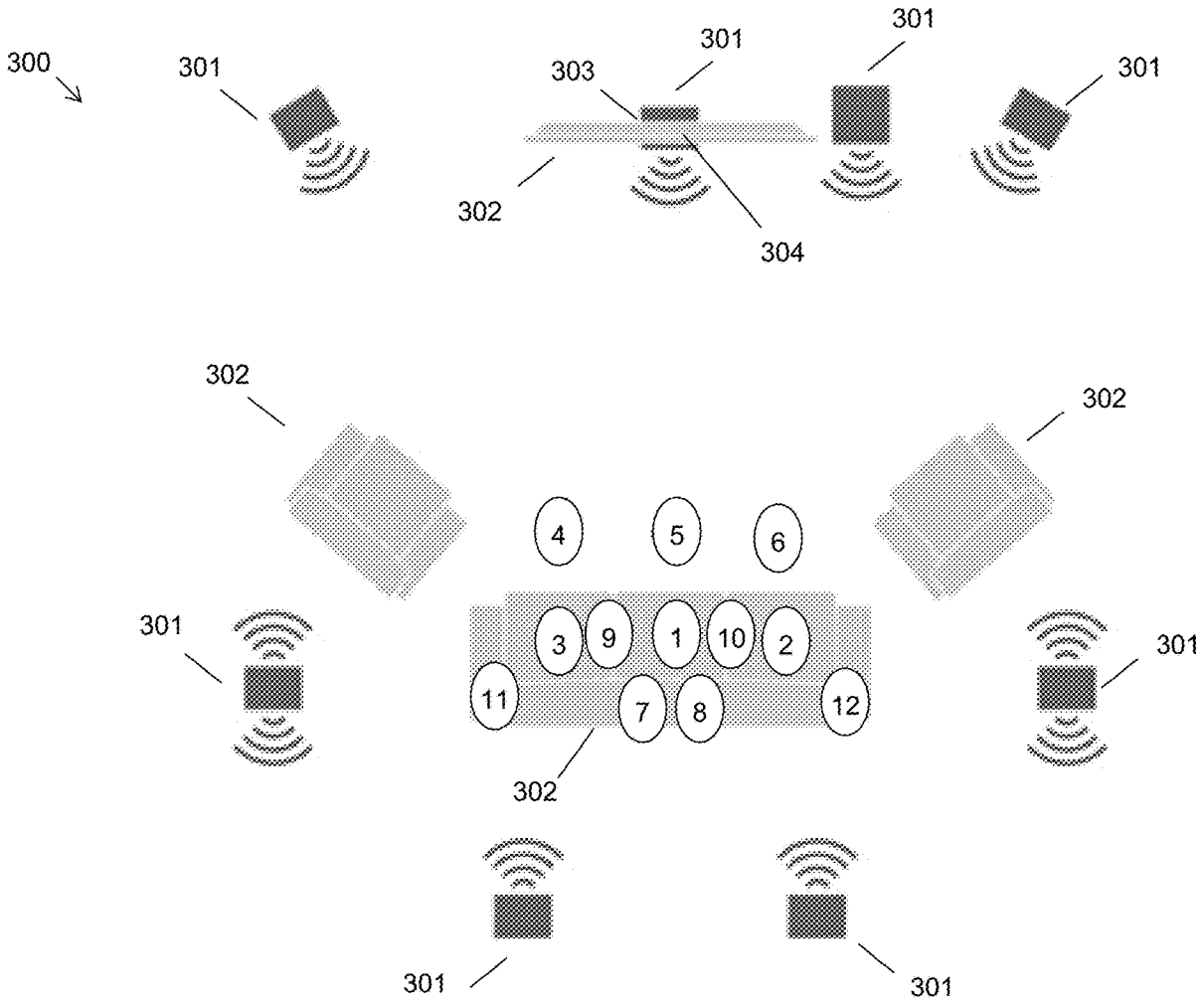
FIG. 3 illustrates an example audio system.

FIG. 3 illustrates an example audio system 300 in an area, e.g., a user's living room. As illustrated, the audio system includes a plurality of speakers 301 as well as objects 302 and a variety of user listening positions (1-12).

As conventionally known, a user might typically tune the audio system 300 by taking a specialized microphone (not shown in FIG. 3) around to each listening position (1-12) and repeatedly playing the audio (test tones) in order to tune the system. As described herein, this is at best time consuming and may be cumbersome enough that it precludes a user from attempting to properly tune the audio system 300.

Accordingly, an embodiment employs a sensor 303, e.g., co-located with an AV receiver 304, in order to capture, using the sensor 303, depth field data of the area. For example, the audio system 300 may include a camera, e.g., embedded within an object 302 such as a television or the like, that captures image(s) that may be used to create depth field data, e.g., regarding the relative locations of objects 302, e.g., a distance between an object 302 and/or speaker 301 and the AV receiver 304. This allows an embodiment to determine or detect, using the depth field data, acoustic characteristics of the area, e.g., based on knowing the relative locations of the objects.

Additional sensor(s) 303 may be used in lieu of, or in addition to, a sensor 303 such as a camera. For example, a sensor 303 such as a combination of sensors, e.g., a camera along with an IR scatter detection unit, may be used to collect the depth field data. Additionally or in the alternative, other sensors 303 may be used, such as sensors that capture image or other like data using non-visible (e.g., IR or other spectrum) light, sound waves, or even reflected light, e.g., reflect laser light.

Additionally, an embodiment may, using the depth field data obtained by a sensor 303, determine additional characteristics of the objects 302 in the area. For example, an embodiment may use the depth field data to determine or infer/estimate a size of the object 302 or even access a database to obtain a pre-determined acoustic characteristic associated with an object 302 identified in the area based on, e.g., depth field data such as might be included in an image. By way of example, an embodiment may first determine a likely identification for an object 302, e.g., a couch, and thereafter access a database (either a remotely located database or a local database) to determine an acoustic characteristic of the object 302 so identified. In such a way, an embodiment may include in the acoustic or sound profile for the area, not only the location(s) of objects, but how such objects may impact the functioning of the audio system 300 with respect to speaker performance. This may include the size and/or shape of the object 302, the object's 302 relative location, and/or the object's 302 acoustic qualities, e.g., an object's likely material construction that influences its acoustic absorbency in a known way. These acoustic qualities or facts relating to an area may make up an acoustic profile for the area that may be used, e.g., as a template, to modify the output(s) to speaker(s) of the system.

Figure 4:
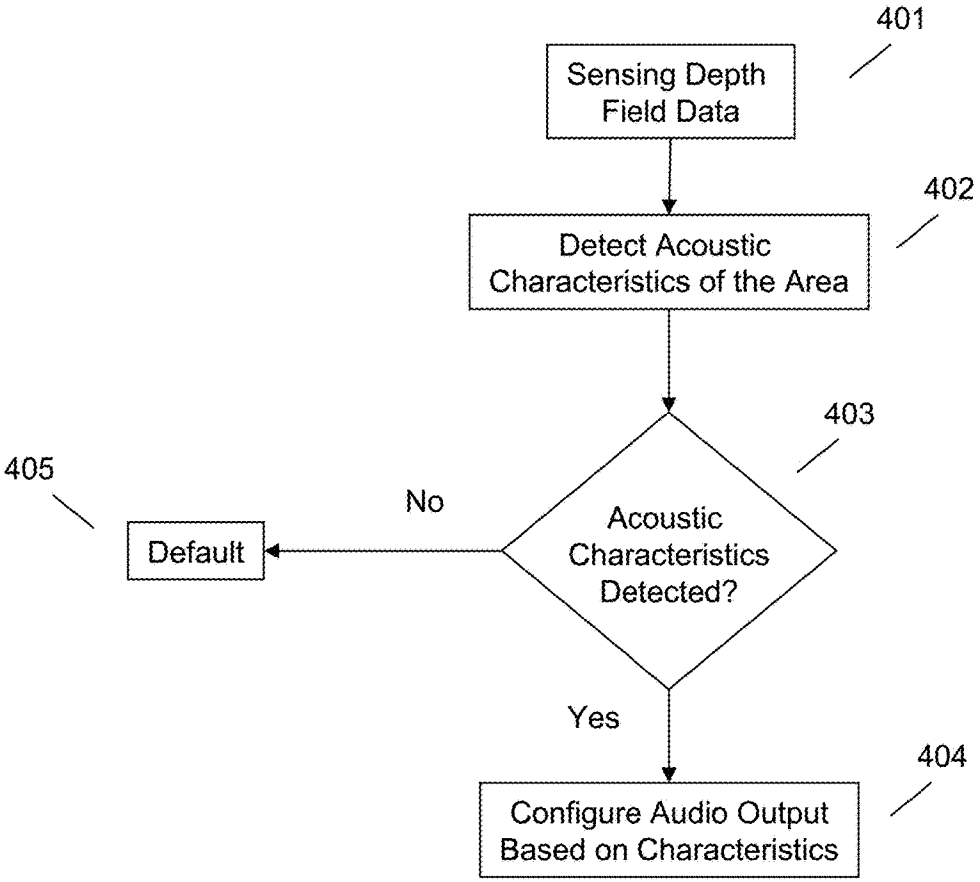
FIG. 4 illustrates an example method of tuning an audio system.

An embodiment may thus, referring to FIG. 4, provide an end user with a convenient method of tuning an audio system. An embodiment may begin a tuning session for an audio system, e.g., system 300, by capturing at 401, using the sensor 303, depth field data of the area. This permits an embodiment to detect acoustic characteristics of the area at 402 based on the depth field data, e.g., the relative locations of objects 302 within the area, likely user listening positions (e.g., 1-12 of FIG. 3), the locations of speaker(s) 301, etc.

If acoustic characteristics are detected, e.g., at 403, this permits an embodiment to create a sound profile of the area, e.g., a model of the acoustic qualities or characteristics of the area, based on the depth field data. This allows an embodiment to create a sound profile for the area in a quick way, such that repeated use of a microphone, e.g., at likely user listening positions, is not required. In at least one embodiment, there is no need to sample audio at any of the likely user positions, as this process may be automated using the sound profile.

If no acoustic characteristics are detected at 403, or if insufficient acoustic characteristics are detected (e.g., a sound profile of quality below a predetermined level), an embodiment may implement a default at 405. For example, an embodiment may set all of the acoustic characteristics to a predetermined setting, e.g., based on a generic or stock sound profile at 405. As part of the default process, an embodiment may notify the user that insufficient depth field data is available, e.g., as determined at 403. In such a case, an embodiment may notify the user that a repeated attempt at collecting depth field data should be conducted and/or that system default settings may or should be implemented.

Using the sound profile, e.g., the detected/determined acoustic characteristics of the objects 302, e.g., the relative location, size, shape and even an object's acoustic qualities, using the depth field data, an embodiment may then automatically configure audio output to one or more speakers 301 of the audio system 300, e.g., at 404. Thus, an embodiment may, as part of forming the sound profile for the area, may identify an object 302, e.g., a couch, is located within the area based on the depth field data at a relative location, e.g., as referenced to an AV receiver 304 of the audio system 300 and at least one of the one or more speakers 301 of the audio system. This will permit an embodiment to automatically modulate the output to a speaker 301.

An embodiment thus utilizes the depth field data that is sensed for the area to take into account the relative locations of the objects 302 and produces an area layout or model. The area layout acts as the basis for a sound profile for the area that influences the output to the speakers 301 rather than collected audio data, e.g., using a conventional microphone collection process. In other words, in an embodiment, depth field data may substitute for the collected audio or complement it, if some is to be collected, in tuning the audio system 300.

An embodiment may configure a variety of audio output characteristics according to the sound profile. For example, configuring audio output to one or more speakers 301 of the audio system 300 based on the acoustic characteristics detected may comprise adjusting timing of the output to the one or more speakers 301. For example, timing of the audio signal directed to particular speakers 301 may be changed to accommodate and take into account their respective locations in the acoustic environment in question, e.g., a speaker's 301 relative location to user listening positions (1-12 of FIG. 3) and to the AV receiver 304.

As another example, an embodiment may configure audio output to one or more speakers 301 by configuring an audio output characteristic such as amplitude, frequency, and balance. Thus, an embodiment may modify the volume of the output to a speaker 301, the tone or frequency of the output to a speaker 301, and/or the balance (including fade) to the speakers 301. This permits an embodiment to shape the sound output of the audio system 300 taking into account the acoustic environment of the area, e.g., as dictated by the sound profile.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a general purpose information handling device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A system, comprising:

a sensor;

a processor operatively coupled to the sensor; and a memory storing instructions executable by the processor to:

capture, using the sensor, depth data related to at least one position within an area;

identify one or more user listening positions within the area using the depth data, wherein the user listening positions are identified based upon object locations within the area;

determine characteristics associated with the one or more user listening positions based on the depth data;

generate, based upon the determined characteristics, a sound profile of the area; and configure, based on the sound profile, audio output to a plurality of speakers of an audio system positioned about the area.

2. The system of claim 1, wherein to determine characteristics comprises:

identifying an object within the area based on the depth data; and determining a relative location of the object based on depth detection.

3. The system of claim 2, wherein the relative location of the object is referenced to a component of the audio system and at least one of the plurality of speakers of the audio system.

4. The system of claim 3, wherein the relative location of the object is used to produce an area layout; and wherein the area layout is used to implement the sound profile for the area.

5. The system claim 4, wherein to configure audio output to a plurality of speakers of an audio system comprises providing audio output according to the sound profile.

6. The system of claim 1, wherein:

the sensor is a camera;

the camera captures an image including depth data; and to determine characteristics comprises identifying an object represented within an image.

7. The system of claim 6, wherein to determine characteristics comprises:

accessing a database to obtain a pre-determined characteristic associated with an object identified in the area based on the image.

8. The system claim 1, wherein to provide audio output to a plurality of speakers of an audio system based on the characteristics comprises adjusting timing of the output to the plurality of speakers.

9. The system of claim 1, wherein to provide audio output to a plurality of speakers comprises configuring an audio output characteristic selected from the group consisting of amplitude, frequency, and balance.

10. The system of claim 1, wherein the sensor is selected from the group consisting of a camera that captures visual images, an image capture device that captures non-visible light, an image capture device that detects reflected light, and a single device that sends and receives acoustic energy.

11. A method, comprising:

capturing, using a sensor, depth data related to at least one position within an area;

identifying, using the processor, one or more user listening positions within the area using the depth data, wherein the user listening positions are identified based upon object locations within the area;

determining, using a processor, characteristics associated with the one or more user listening positions based on the depth data;

generating, based upon the determined characteristics, a sound profile of the area; and configuring, using a processor and based on the sound profile, audio output to a plurality of speakers of an audio system positioned about the area.

12. The method of claim 11, wherein determining characteristics comprises:

identifying an object within the area based on the depth data; and determining a relative location of the object based on depth detection.

13. The method of claim 12, wherein the relative location of the object is referenced to a component of the audio system and at least one of the plurality of speakers of the audio system.

14. The method of claim 13, wherein the relative location of the object is used to produce an area layout; and wherein the area layout is used to implement the sound profile for the area.

15. The method claim 14, wherein configuring audio output to a plurality of speakers of an audio system comprises providing audio output according to the sound profile.

16. The method of claim 11, wherein:

the sensor is a camera;

the camera captures an image including depth data; and determining characteristics comprises identifying an object represented within an image.

17. The method of claim 16, wherein determining characteristics comprises:

accessing a database to obtain a pre-determined characteristic associated with an object identified in the area based on the image.

18. The method claim 11, wherein providing audio output to a plurality of speakers of an audio system based on the characteristics comprises adjusting timing of the output to the plurality of speakers.

19. The method of claim 11, wherein providing audio output to one or more speakers comprises providing an audio output characteristic selected from the group consisting of amplitude, frequency, and balance.

20. A computer program product, comprising:

a computer readable storage device having program executable code embodied therewith, the code being executable by a processor and comprising:

code that captures, using a sensor, depth data related to at least one position within an area;

code that identifies one or more user listening positions within the area using the depth data, wherein the user listening positions are identified based upon object locations within the area;

code that determines, using a processor, characteristics associated with the one or more user listening positions based on the depth data;

code that generates, based upon the determined characteristics, a sound profile for the area; and code that configures, based on the sound profile, audio output to a plurality of speakers of an audio system positioned about the area.

* * * * *